US008179278B2

(12) United States Patent
Shakra et al.

(10) Patent No.: US 8,179,278 B2
(45) Date of Patent: May 15, 2012

(54) DOWNHOLE COMMUNICATION DEVICES AND METHODS OF USE

(75) Inventors: Fred Shakra, Cheltenham (GB); Phil Louden, Weston-super-Mare (GB); Spyro Kotsonis, Cheltenham (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 708 days.

(21) Appl. No.: 12/325,499

(22) Filed: Dec. 1, 2008

(65) Prior Publication Data

US 2010/0133006 A1 Jun. 3, 2010

(51) Int. Cl.
*G01V 3/34* (2006.01)
*E21B 47/16* (2006.01)

(52) U.S. Cl. ..... 340/854.4; 340/855.5; 340/855.8; 367/82; 175/40; 175/57

(58) Field of Classification Search ..... 340/854.3, 340/853.1, 854.4, 855, 855.8, 855.5; 367/81–83; 175/40, 57

See application file for complete search history.

(56) References Cited

U.S. PATENT DOCUMENTS

| | | | | |
|---|---|---|---|---|
| 4,200,831 | A | 4/1980 | Weldon et al. | |
| 4,578,675 | A * | 3/1986 | MacLeod | 340/853.7 |
| 5,113,953 | A | 5/1992 | Noble | |
| 5,265,682 | A | 11/1993 | Russell et al. | |
| 5,520,255 | A | 5/1996 | Barr et al. | |
| 5,553,678 | A | 9/1996 | Barr et al. | |
| 5,553,679 | A | 9/1996 | Thorp et al. | |
| 5,565,759 | A | 10/1996 | Dunstan et al. | |
| 5,582,259 | A | 12/1996 | Barr et al. | |
| 5,603,385 | A | 2/1997 | Colebrook et al. | |
| 5,673,763 | A | 10/1997 | Thorp et al. | |
| 5,685,379 | A | 11/1997 | Barr et al. | |
| 5,695,015 | A | 12/1997 | Barr et al. | |
| 5,706,905 | A | 1/1998 | Barr et al. | |
| 5,778,992 | A | 7/1998 | Fuller et al. | |
| 5,803,185 | A | 9/1998 | Barr et al. | |
| 5,924,499 | A * | 7/1999 | Birchak et al. | 175/40 |
| 5,971,085 | A | 10/1999 | Colebrook et al. | |
| 6,089,332 | A | 7/2000 | Barr et al. | |
| 6,092,610 | A | 7/2000 | Kosmala et al. | |
| 6,158,529 | A | 12/2000 | Dorel | |
| 6,191,556 | B1 | 2/2001 | Galbraith et al. | |
| 6,244,361 | B1 | 6/2001 | Comeau et al. | |
| 6,271,647 | B2 | 8/2001 | Galbraith et al. | |
| 6,364,034 | B1 | 4/2002 | Schoeffler | |

(Continued)

FOREIGN PATENT DOCUMENTS

GB 2444957 A * 6/2008

(Continued)

OTHER PUBLICATIONS

Samuel, G. Robello, "Downhole Drilling Tools: Theory & Practice for Engineers & Students" 288-333 (2007).

(Continued)

*Primary Examiner* — Jennifer H Gay
(74) *Attorney, Agent, or Firm* — Jeremy P. Welch

(57) ABSTRACT

A downhole communication device comprises a first energy harvesting device; a downhole transceiver in communication with the first energy harvesting device; an accumulator in communication with the energy harvesting device; and a microcontroller. The microcontroller manages communication between the first energy harvesting device, transceiver, and accumulator.

19 Claims, 3 Drawing Sheets

U.S. PATENT DOCUMENTS

| | | | | |
|---|---|---|---|---|
| 6,394,193 | B1 | 5/2002 | Askew | |
| 6,449,726 | B1 | 9/2002 | Smith et al. | |
| 6,538,449 | B2 | 3/2003 | Juncker et al. | |
| 6,842,708 | B2 | 1/2005 | Odaohhara et al. | |
| 6,870,349 | B2 | 3/2005 | Cook et al. | |
| 7,287,604 | B2 | 10/2007 | Aronstam et al. | |
| 7,295,129 | B2 | 11/2007 | Eisenson et al. | |
| 7,360,610 | B2 | 4/2008 | Hall et al. | |
| 7,400,262 | B2 * | 7/2008 | Chemali et al. | 340/854.3 |
| 7,439,745 | B2 | 10/2008 | Suzuki et al. | |
| 7,721,822 | B2 * | 5/2010 | Krueger et al. | 175/57 |
| 2001/0001532 | A1 | 5/2001 | Galbraith et al. | |
| 2001/0052428 | A1 | 12/2001 | Larronde et al. | |
| 2002/0011359 | A1 | 1/2002 | Webb et al. | |
| 2002/0142215 | A1 * | 10/2002 | Goenka et al. | 429/162 |
| 2005/0207279 | A1 * | 9/2005 | Chemali et al. | 367/83 |
| 2006/0131030 | A1 | 6/2006 | Sheffield et al. | |
| 2006/0191681 | A1 | 8/2006 | Storm et al. | |
| 2007/0029974 | A1 | 2/2007 | Uchida et al. | |
| 2007/0079997 | A1 * | 4/2007 | Chan et al. | 180/7.1 |
| 2007/0154341 | A1 | 7/2007 | Saenger et al. | |
| 2008/0004839 | A1 | 1/2008 | Papadimitriou et al. | |
| 2008/0033653 | A1 * | 2/2008 | Pabon et al. | 702/6 |
| 2008/0179098 | A1 | 7/2008 | Hall et al. | |
| 2010/0133006 | A1 * | 6/2010 | Shakra et al. | 175/24 |
| 2010/0165788 | A1 * | 7/2010 | Rayssiguier et al. | 367/25 |
| 2011/0114387 | A1 * | 5/2011 | Belcher et al. | 175/57 |
| 2011/0149687 | A1 * | 6/2011 | Rayssiguier et al. | 367/82 |
| 2011/0176387 | A1 * | 7/2011 | Froelich | 367/82 |

FOREIGN PATENT DOCUMENTS

| | | | |
|---|---|---|---|
| WO | WO 2010065431 | A1 * | 6/2010 |

OTHER PUBLICATIONS

"Standard Handbook of Petroleum & Natural Gas Engineering" 4-276-4-299 (William C. Lyons & Gary J. Plisga eds. 2006).

Gelfgat, Yakov A et al., 1 Advanced Drilling Solutions: Lessons from the FSU 154-72 (2003).

* cited by examiner

DOWNHOLE COMMUNICATION DEVICES AND METHODS OF USE

TECHNICAL FIELD

The invention provides downhole communication devices and methods of using downhole communication devices.

BACKGROUND

Electrical generation is a persistent challenge in downhole drilling environments. Transmission of power from the surface is often not practicable. Accordingly, downhole power generation devices such as mud motors are often used. While such devices often be incorporated at the end of a drill string, mud motors are generally too large both in terms of size and power output for relay devices distributed along the drill string. Accordingly, there is a need for power generation devices that are capable of installation and power generation along a drill string.

SUMMARY OF THE INVENTION

The invention provides downhole communication devices and methods of using downhole communication devices.

One aspect of the invention provides a downhole communication device including: a first energy harvesting device; a downhole transceiver in communication with the first energy harvesting device; an accumulator in communication with the energy harvesting device; and a microcontroller. The microcontroller manages communication between the first energy harvesting device, transceiver, and accumulator.

This aspect can have several embodiments. The downhole communication device can include a sensor in communication with the microcontroller and the downhole transceiver. The sensor can be in wired or wireless communication with the microcontroller.

The downhole communication device can include a second energy harvesting device. The second energy harvesting device can be in communication with the sensor. The downhole transceiver can be in communication with a second downhole transceiver located distant to the first downhole transceiver.

The first energy harvesting device can be a substantially continuous power generator. The substantially continuous power generator can be one or more selected from the group consisting of: a triboelectric generator, an electromagnetic generator, and a thermoelectric generator. The first energy harvesting device can be a sporadic power generator. The sporadic power generator can be a piezoelectric generator.

The accumulator can be one or more selected from the group consisting of: a hydro-pneumatic accumulator, a spring accumulator, an electrochemical cell, a battery, a rechargeable battery, a lead-acid battery, a capacitor, and a compulsator. The microcontroller can be configured to regulate the release of power from the accumulator. The microcontroller can estimate existing energy stored in the accumulator. The downhole transceiver can be selected from the group consisting of: an electrical transceiver, a hydraulic transceiver, and an acoustic transceiver.

Another aspect of the invention provides a drilling control system including: a downhole communication device and at least one repeater. The downhole communication device includes: a first energy harvesting device; a first downhole transceiver in communication with the first energy harvesting device; a first accumulator in communication with the first energy harvesting device; a first microcontroller; and a sensor in communication with the microcontroller and the first downhole transceiver. The first microcontroller manages communication between the first energy harvesting device, the first downhole transceiver, and the first accumulator. The repeater includes: a second energy harvesting device; a second downhole transceiver in communication with the second energy harvesting device; a second accumulator in communication with the second energy harvesting device; and a second microcontroller. The second microcontroller manages communication between the second energy harvesting device, the second downhole transceiver, and the second accumulator.

This aspect can have several embodiments. The drilling control system can include an uphole communication device. The uphole control device can include: a power source and a receiver electrically coupled to the power source. The uphole communication device can include a transmitter electrically coupled to the power source. The downhole communication device can include a receiver electrically coupled with the microprocessor.

Another aspect of the invention provides a method of downhole drilling. The method includes the steps of: providing a downhole component; providing at least one repeater; providing an uphole component; obtaining drilling data from the sensor; transmitting the drilling data from the downhole component to the first of the at least one repeater; relaying the drilling data to any subsequent repeaters; and transmitting the drilling data from the last of the least one repeater to the uphole component. The downhole component includes: a first energy harvesting device; a first downhole transceiver in communication with the first energy harvesting device; a first accumulator in communication with the first energy harvesting device; a first microcontroller; and a sensor in communication with the microcontroller and the first downhole transceiver. The first microcontroller manages communication between the first energy harvesting device, the first downhole transceiver, and the first accumulator. The at least one repeater includes: a second energy harvesting device; a second downhole transceiver in communication with the second energy harvesting device; a second accumulator in communication with the second energy harvesting device; and a second microcontroller. The second microcontroller manages communication between the second energy harvesting device, the second downhole transceiver, and the second accumulator. The uphole component includes: a power source and a receiver electrically coupled to the power source.

DESCRIPTION OF THE DRAWINGS

For a fuller understanding of the nature and desired objects of the present invention, reference is made to the following detailed description taken in conjunction with the accompanying drawing figures wherein like reference characters denote corresponding parts throughout the several views and wherein.

DETAILED DESCRIPTION OF THE INVENTION

The invention provides downhole communication devices and methods of using downhole communication devices. Some embodiments of the invention can be used in a wellsite system.

Wellsite System

Figure 1:
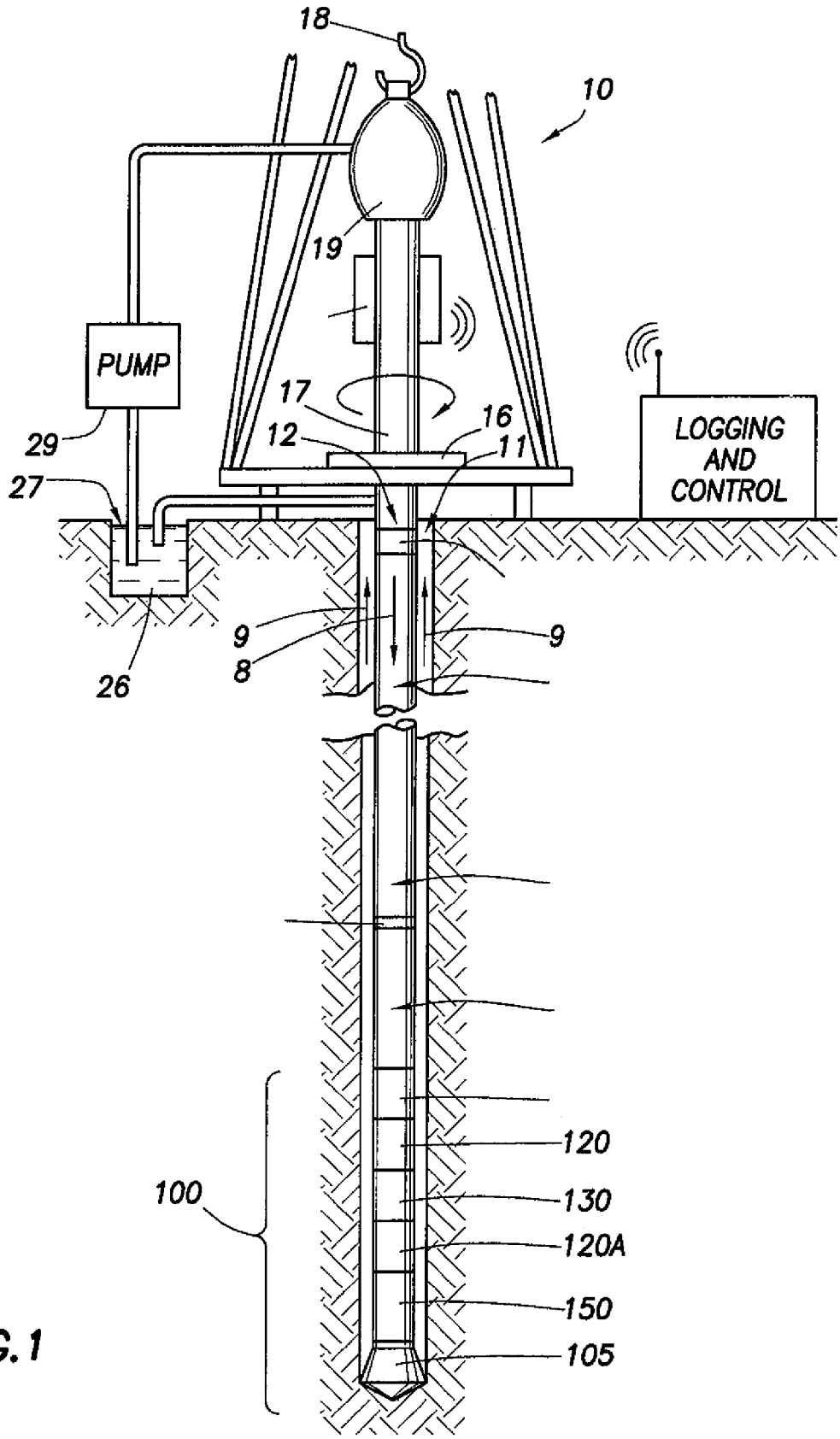
FIG. 1 illustrates a wellsite system in which the present invention can be employed in accordance with one embodiment of the invention.

FIG. 1 illustrates a wellsite system in which the present invention can be employed. The wellsite can be onshore or offshore. In this exemplary system, a borehole 11 is formed in subsurface formations by rotary drilling in a manner that is well known. Embodiments of the invention can also use directional drilling, as will be described hereinafter.

A drill string 12 is suspended within the borehole 11 and has a bottom hole assembly (BHA) 100 which includes a drill bit 105 at its lower end. The surface system includes platform and derrick assembly 10 positioned over the borehole 11, the assembly 10 including a rotary table 16, kelly 17, hook 18 and rotary swivel 19. The drill string 12 is rotated by the rotary table 16, energized by means not shown, which engages the kelly 17 at the upper end of the drill string. The drill string 12 is suspended from a hook 18, attached to a traveling block (also not shown), through the kelly 17 and a rotary swivel 19 which permits rotation of the drill string relative to the hook. As is well known, a top drive system could alternatively be used.

In the example of this embodiment, the surface system further includes drilling fluid or mud 26 stored in a pit 27 formed at the well site. A pump 29 delivers the drilling fluid 26 to the interior of the drill string 12 via a port in the swivel 19, causing the drilling fluid to flow downwardly through the drill string 12 as indicated by the directional arrow 8. The drilling fluid exits the drill string 12 via ports in the drill bit 105, and then circulates upwardly through the annulus region between the outside of the drill string and the wall of the borehole, as indicated by the directional arrows 9. In this well known manner, the drilling fluid lubricates the drill bit 105 and carries formation cuttings up to the surface as it is returned to the pit 27 for recirculation.

The bottom hole assembly 100 of the illustrated embodiment includes a logging-while-drilling (LWD) module 120, a measuring-while-drilling (MWD) module 130, a roto-steerable system and motor, and drill bit 105.

The LWD module 120 is housed in a special type of drill collar, as is known in the art, and can contain one or a plurality of known types of logging tools. It will also be understood that more than one LWD and/or MWD module can be employed, e.g. as represented at 120A. (References, throughout, to a module at the position of 120 can alternatively mean a module at the position of 120A as well.) The LWD module includes capabilities for measuring, processing, and storing information, as well as for communicating with the surface equipment. In the present embodiment, the LWD module includes a pressure measuring device.

The MWD module 130 is also housed in a special type of drill collar, as is known in the art, and can contain one or more devices for measuring characteristics of the drill string and drill bit. The MWD tool further includes an apparatus (not shown) for generating electrical power to the downhole system. This can typically include a mud turbine generator (also known as a "mud motor") powered by the flow of the drilling fluid, it being understood that other power and/or battery systems can be employed. In the present embodiment, the MWD module includes one or more of the following types of measuring devices: a weight-on-bit measuring device, a torque measuring device, a vibration measuring device, a shock measuring device, a stick slip measuring device, a direction measuring device, and an inclination measuring device.

A particularly advantageous use of the system hereof is in conjunction with controlled steering or "directional drilling." In this embodiment, a roto-steerable subsystem 150 (FIG. 1) is provided. Directional drilling is the intentional deviation of the wellbore from the path it would naturally take. In other words, directional drilling is the steering of the drill string so that it travels in a desired direction.

Directional drilling is, for example, advantageous in offshore drilling because it enables many wells to be drilled from a single platform. Directional drilling also enables horizontal drilling through a reservoir. Horizontal drilling enables a longer length of the wellbore to traverse the reservoir, which increases the production rate from the well.

A directional drilling system can also be used in vertical drilling operation as well. Often the drill bit will veer off of a planned drilling trajectory because of the unpredictable nature of the formations being penetrated or the varying forces that the drill bit 105 experiences. When such a deviation occurs, a directional drilling system can be used to put the drill bit 105 back on course.

A known method of directional drilling includes the use of a rotary steerable system ("RSS"). In an RSS, the drill string is rotated from the surface, and downhole devices cause the drill bit 105 to drill in the desired direction. Rotating the drill string greatly reduces the occurrences of the drill string getting hung up or stuck during drilling. Rotary steerable drilling systems for drilling deviated boreholes into the earth can be generally classified as either "point-the-bit" systems or "push-the-bit" systems.

In the point-the-bit system, the axis of rotation of the drill bit 105 is deviated from the local axis of the bottom hole assembly in the general direction of the new hole. The hole is propagated in accordance with the customary three-point geometry defined by upper and lower stabilizer touch points and the drill bit 105. The angle of deviation of the drill bit axis coupled with a finite distance between the drill bit 105 and lower stabilizer results in the non-collinear condition required for a curve to be generated. There are many ways in which this can be achieved including a fixed bend at a point in the bottom hole assembly close to the lower stabilizer or a flexure of the drill bit drive shaft distributed between the upper and lower stabilizer. In its idealized form, the drill bit 105 is not required to cut sideways because the bit axis is continually rotated in the direction of the curved hole. Examples of point-the-bit type rotary steerable systems, and how they operate are described in U.S. Patent Application Publication Nos. 2002/0011359; 2001/0052428 and U.S. Pat. Nos. 6,394,193; 6,364,034; 6,244,361; 6,158,529; 6,092,610; and 5,113,953.

In the push-the-bit rotary steerable system there is usually no specially identified mechanism to deviate the bit axis from the local bottom hole assembly axis; instead, the requisite non-collinear condition is achieved by causing either or both of the upper or lower stabilizers to apply an eccentric force or displacement in a direction that is preferentially orientated with respect to the direction of hole propagation. Again, there are many ways in which this can be achieved, including non-rotating (with respect to the hole) eccentric stabilizers (displacement based approaches) and eccentric actuators that apply force to the drill bit 105 in the desired steering direction. Again, steering is achieved by creating non co-linearity between the drill bit 105 and at least two other touch points. In its idealized form, the drill bit 105 is required to cut side ways in order to generate a curved hole. Examples of push-the-bit type rotary steerable systems and how they operate are described in U.S. Pat. Nos. 5,265,682; 5,553,678; 5,803,185; 6,089,332; 5,695,015; 5,685,379; 5,706,905; 5,553,679; 5,673,763; 5,520,255; 5,603,385; 5,582,259; 5,778,992; and 5,971,085.

Downhole Devices

Figure 2:
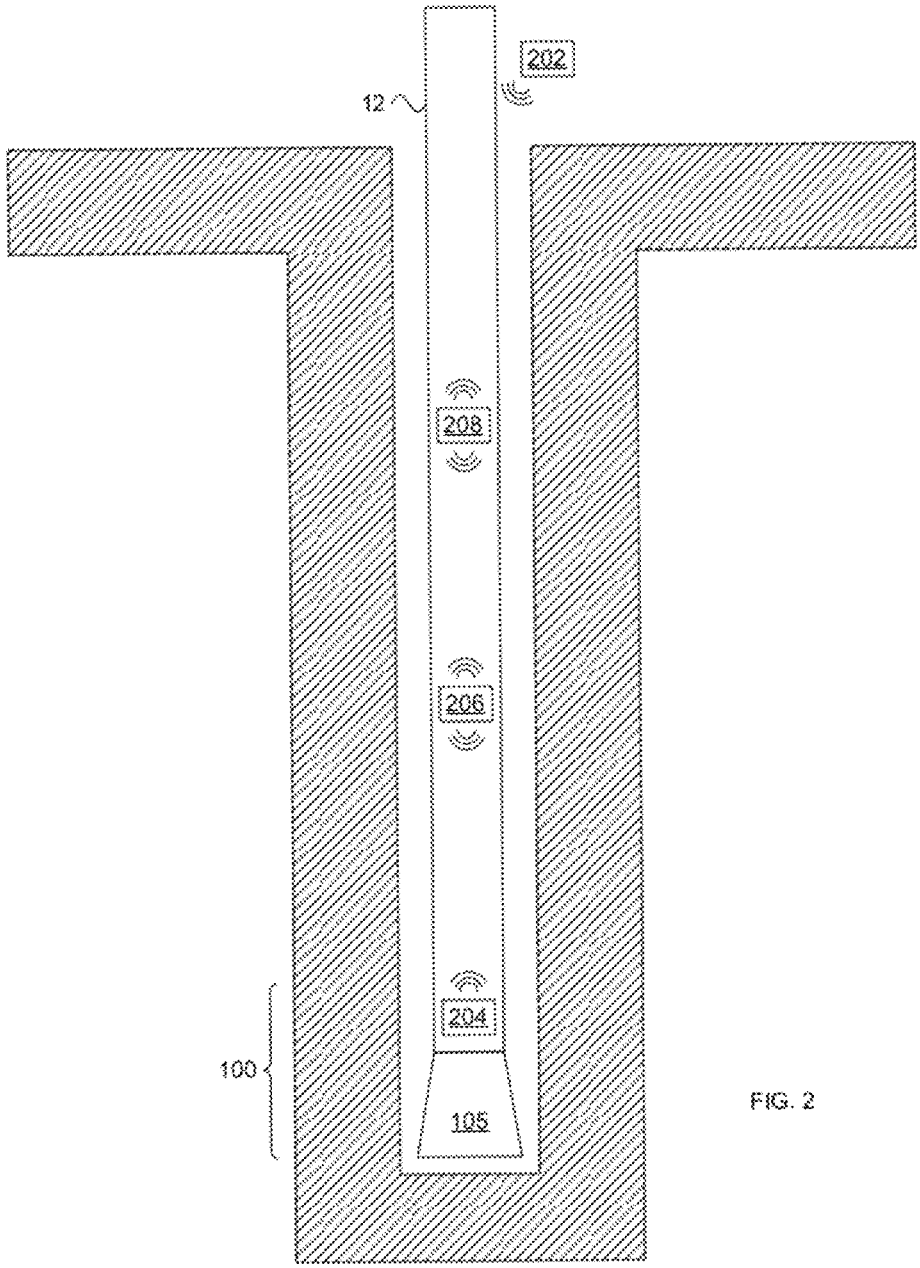
FIG. 2 illustrates a general topology for communication between a bottom hole assembly and an uphole communication device in accordance with one embodiment of the invention.

FIG. 2 depicts a general topology of for communication between a bottom hole assembly 100 and an uphole communication device 202. A downhole communication device 204 is positioned within or in proximity to bottom hole assembly 100. The downhole communication device can receive information from sensors in the bottom hole assembly 100 and/or drill bit 105. The downhole communication device 204 can, in some embodiments, communicate with one or more repeaters 206, 208 along drill string 12, which relay communications to uphole communication device 202. Each of the downhole control device 204 and the repeaters 206, 208 can be standalone devices that are self-powered and communicate wirelessly. The distance between uphole communication device 202, downhole communication device 204, and repeaters 206, 208 can vary depending on the drilling environment and the communication technology and protocol used. In some embodiments, repeaters 206, 208 are placed about every one foot, every two feet, every three feet, every four feet, every five feet, every six feet, every seven feet, every eight feet, every nine feet, every ten feet, every fifteen feet, every twenty feet, every twenty-five feet, and the like.

Figure 3:
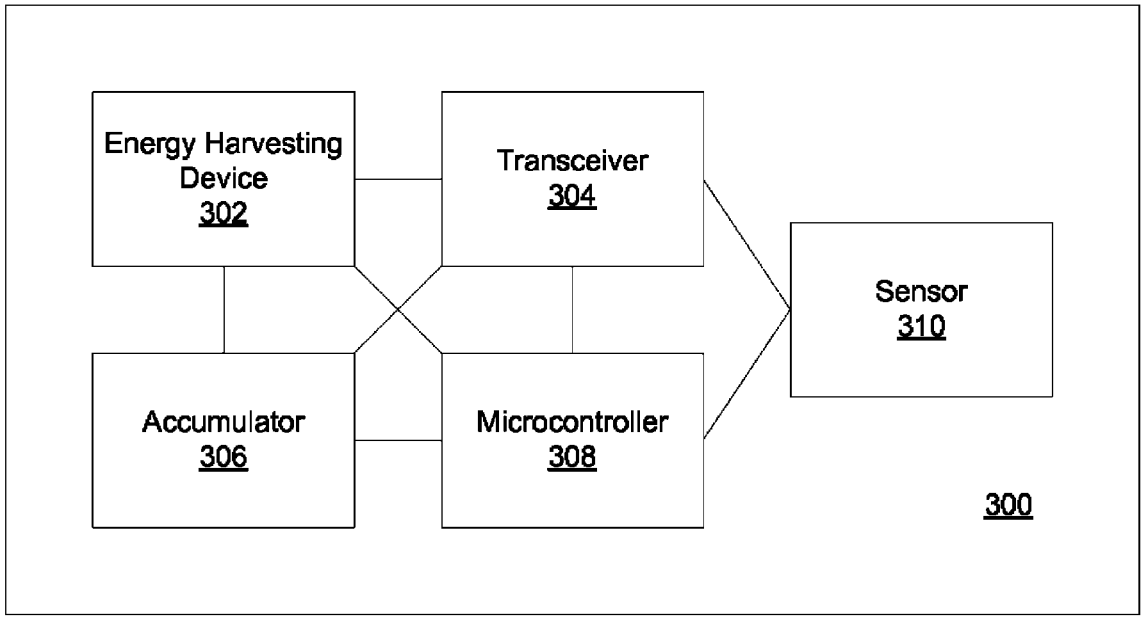
FIG. 3 illustrates a downhole communication device in accordance with one embodiment of the invention.

FIG. 3 depicts a downhole communication device 300 according to one embodiment of the invention. The downhole device 300 includes an energy harvesting device 302, a transceiver 304, an accumulator 306, a microcontroller 308, and a sensor 310. Each of these components can be in communication with each other, either directly or indirectly (i.e. through one or more other components).

One or more energy harvesting devices 302 can be provided to generated power in the downhole environment. The energy harvesting device 302 can be a substantially continuous power generator and/or a sporadic power generator. Substantially continuous power generators gather power from substantially constant sources such as temperature and mechanical forces. For example, a substantially continuous power generator can be a thermogenerator, which harnesses temperature differences into electrical energy by using the Seebeck effect. Thin thermogenerators incorporating p-n junctions (e.g. incorporating bismuth telluride) can be formed in strips or rings that can be mounted on a drill string. Heat is generated one side of the thermogenerator by friction produced by rotation of the drill string in the borehole 11. Mud flowing through the drill string cools the other side of the thermogenerator to produce a temperature difference.

In another embodiment, the substantially continuous power generator can be a mechanical power generator such as an electromagnetic turbine spun by a mud motor. Mud motors are described in a number of publications such as G. Robello Samuel, *Downhole Drilling Tools: Theory & Practice for Engineers & Students* 288-333 (2007); *Standard Handbook of Petroleum & Natural Gas Engineering* 4-276-4-299 (William C. Lyons & Gary J. Plisga eds. 2006); and 1 Yakov A. Gelfgat et al., *Advanced Drilling Solutions: Lessons from the FSU* 154-72 (2003).

The substantially continuous power generator can also be a triboelectric generator that generates electricity by contacting and separating different materials. Different materials can be selected in accordance with the triboelectric series, which orders materials based on the polarity of charge separation when touched with another object. Materials in the triboelectric series include: glass, quartz, mica, nylon, lead, aluminum (the preceding in order from most positively charged to least positively charged), steel (no charge), poly(methyl methacrylate), amber, acrylics, polystyrene, resins, hard rubber, nickel, copper, sulfur, brass, silver, gold, platinum, acetate, synthetic rubber, polyester, styrene, polyurethane, polyethylene, polypropylene, vinyl, silicon, polytetrafluoroethylene, and silicone rubber (the preceding in order from least negatively charged to most negatively charged). Tribeoelectric generation can be maximized by selecting materials that are distant from each other in the triboelectric series.

Triboelectricity can be generated by connecting one material to a rotating device such as a mud motor. In another embodiment, one triboelectric material can be mounted in the inside of a ring adapted to slip against the drill string as the drill string rotates. The other triboelectric material can be mounted on the exterior of the drill string.

The one or more energy harvesting devices 302 can also be a sporadic power generator, such as a piezoelectric generator. Piezoelectric materials generate electricity when stress is applied. Suitable piezoelectric materials include berlinite ($AlPO_4$), cane sugar, quartz ($SiO_2$), Rochelle salt ($KNaC_4H_4O_6.4H_2O$), topaz ($Al_2$—$SiO_4(F,OH)_2$), tourmaline-group minerals, gallium othrophosphate ($GaPO_4$), langasite ($La_3Ga_5SiO_{14}$), barium titanate ($BaTiO_3$), lead titanate ($PbTiO_3$), lead zirconate titanate ($Pb[Zr_xTi_{1-x}]O_3$, $0<x<1$), potassium niobate ($KNbO_3$), lithium niobate ($LiNbO_3$), lithium tantalite ($LiTaO_3$), sodium tungstate ($Na_2WO_3$), $Ba_2NaNbO_5$, $Pb_2KNb_5O_{15}$, polyvinylide fluoride ($—(CH_2CF_2)_n—$), sodium potassium niobate, and bismuth ferrite ($BiFeO_3$).

Piezoelectric materials can be located at any point in the drill string as the entire drill string is subject to shocks and vibrations during the drilling process. Particularly suitable locations include the outside of the drill string, bottom hole assembly 100, drill bit 105, or inside connectors between various drill string components.

Transceiver 304 can be any device capable of transmitting and/or receiving data.

Such devices include, for example, radio devices operating over the Extremely Low Frequency (ELF), Super Low Frequency (SLF), Ultra Low Frequency (ULF), Very Low Frequency (VLF), Low Frequency (LF), Medium Frequency (MF), High Frequency (HF), or Very High Frequency (VHF) ranges; microwave devices operating over the Ultra High Frequency (UHF), Super High Frequency (SHF), or Extremely High Frequency (EHF) ranges; infrared devices operating over the far-infrared, mid-infrared, or near-infrared ranges; a visible light device, an ultraviolet device, an X-ray device, and a gamma ray device. The transceiver 304 can additionally or alternatively transmit and/or receive data by acoustic or ultrasound waves, or by via a sequence of pulses in the drilling fluid (e.g. mud). Mud communication systems are described in U.S. Patent Publication No. 2006/0131030, herein incorporated by reference. Suitable systems are available under the POWERPULSE™ trademark from Schlumberger Technology Corporation of Sugar Land, Tex. In another embodiment, the metal of the drill string (e.g. steel) can be used as a conduit for communications.

Accumulator 306 can be a hydro-pneumatic accumulator, a spring accumulator, an electrochemical cell, a battery, a rechargeable battery, a lead-acid battery, a capacitor, and/or a compulsator.

A hydro-pneumatic accumulator utilizes existing electricity (e.g. from a sporadic or substantially continuous power generator) to pump a fluid (e.g. gas or liquid into a pressure tank). When electricity is needed at a later point, the pressurized fluid is used to power a turbine to generate electricity.

In another embodiment, a compression spring is added to the pressure tank in a hydro-pneumatic accumulator to provide pressure to a diaphragm that provides substantially constant pressure to the fluid in the tank.

In another embodiment, the accumulator is an electrochemical cell, such as a battery, a rechargeable battery, or a lead-acid battery. Electrochemical cells generate an electromotive force (voltage) from chemical reactions. Examples of rechargeable batteries include lead and sulfuric acid batteries, alkaline batteries, nickel cadmium (NiCd) batteries, nickel hydrogen (NiH2) batteries, nickel metal hydride (NiMH), lithium ion (Li-ion), lithium ion polymer (Li-ion polymer), and the like.

Capacitors store energy in the electric field between a pair of conductors known as "plates".

A compulsator or "compensated pulsed alternator" stores electrical energy by "spinning up" a rotor that can be later used to turn an electric motor when power is needed. Compulsators are described in U.S. Pat. No. 4,200,831.

Microcontroller 308 can be any hardware and/or software device capable of one or more of the following functions: (i) controlling the operation (e.g. electricity production) of energy harvesting device 302 and/or accumulator 306; (ii) processing data from transceiver 304 and/or sensor 310; and (iii) controlling communication between sensor 310 and transceiver 304.

Microcontroller 308 can include an integrated central processing unit (CPU), memory (e.g. random access memory (RAM), program memory), and/or peripheral(s) capable of input and/or output. The memory can store one or more programs handling the tasks described above. The microcontroller 308 can include other features such as an analog to digital converter, a timer (e.g. a Programmable Interval Timer), a Time Processing Unit (TPU), a pulse width modulator, and/or a Universal Asynchronous Receiver/Transmitter (UART).

Microcontroller 308 can support interrupts to process events in components such as energy harvesting device 302, transceiver 304, accumulator 306, and/or sensor 310. Interrupts can include errors, exceptional events such sensor values that are exceed a designated value, and the like.

Microcontroller 308 can also control one or more steering devices (not depicted) located within and/or adjacent to drill bit 105 and/or bottom hole assembly 100. The selective actuation of steering devices can point the bit and/or push the bit to drill a hole a desired direction as described herein.

Microcontroller 308 can estimate the energy stored in accumulator 306. Various methods for estimating stored energy are described in U.S. Pat. Nos. 5,565,759; 6,191,556; 6,271,647; 6,449,726; 6,538,449; 6,842,708; 6,870,349; 7,295,129; and 7,439,745; and U.S. Patent Publication Nos. 2001/0001532; 2007/0029974; and 2008/0004839.

Microcontroller 308 can also regulate the power flow from accumulator 306 and/or energy harvesting device 302 to maintain a desired level and/or duration of performance. For example, the microcontroller 308 can selectively power on and/or power off transceiver 304 and/or sensor(s) 310 to conserve power. Microcontroller 308 can implement one or more power schemes to adjust the frequency and/or transmission power of signals from transceiver 304 and/or sensor(s) 310 based on the amount of power available from accumulator 306 and/or energy harvesting device 302. For example, if the accumulator 306 has about 180 seconds of power, the energy harvesting device 302 is generating about 20 seconds of power per minute, and sensor(s) 310 and transceiver 304 require about 30 seconds of power to obtain and transmit data, the microcontroller 308 can power sensor(s) 310 and transceiver 304 every two minutes to maintain adequate power. Microcontroller 308 can further optimize the operation of sensor(s) 310 and transceiver 304, for example, by powering on transceiver after the required data is received from sensor(s) 310 in order to conserve electricity.

Downhole control device 204 can be synchronized with repeaters 206, 208, and uphole communication device 202 to conserve electricity. For example, microcontrollers 308 in each device can selectively power sensor(s) 310 and/or transceiver 304 at defined intervals (e.g. every minute, every two minutes, etc.) to transmit and receive data. In some embodiments, the uphole transceiver is continuously powered on as this device can often be connected to durable power source such as line voltage and/or a transformer, but can still coordinate transmissions with the designated times for repeaters 206, 208 and downhole communication device 204.

Sensor 310 can include one more devices such as a three-axis accelerometer and/or magnetometer sensors to detect the inclination and azimuth of the bottom hole assembly 100. Sensor 310 can also provide formation characteristics or drilling dynamics data to control unit. Formation characteristics can include information about adjacent geologic formation gathered from ultrasound or nuclear imaging devices such as those discussed in U.S. Patent Publication No. 2007/0154341, the contents of which is hereby incorporated by reference herein. Drilling dynamics data can include measurements of the vibration, acceleration, velocity, and temperature of the bottom hole assembly 100.

The sensor(s) 310 and microcontroller 308 can be communicatively coupled by a variety of wired or wireless devices or standards. Examples of standards include parallel or serial ports, Universal Serial Bus (USB), USB 2.0, Firewire, Ethernet, Gigabit Ethernet, IEEE 802.11 ("Wi-Fi"), and the like.

Sensor 310 can be powered by powered by energy harvesting device 302 and/or a second energy harvesting device (i.e. an energy harvesting device other than energy harvesting device 302). The second energy harvesting device can be any of the energy harvesting devices discussed herein. The sensor 310 can be powered sporadically as sufficient power is available.

Repeaters 206, 208 can include similar components to downhole communication device 204. These components can include energy harvesting device 302, transceiver 304, accumulator 306, and microprocessor 308. In many embodiments, repeaters 206, 208 will not include sensor(s) 310, but such an embodiment is within the scope of the invention.

Repeaters 206, 208 can amplify an input signal and/or reshape and/or retime the input signal before producing an output signal. The nature of the repeater can vary depending on the nature of the input signals, as reshaping and retiming is generally only appropriate for digital signals. In some embodiments, repeaters 206, 208 will send and receive on different frequencies to avoid interference. Repeaters 206, 208 can relay data in both the uphole and/or downhole direction.

Uphole control device 202 can include similar components to downhole communication device 204. These components can include transceiver 304 and microprocessor 308. In many embodiments, uphole control device 202 will not include sensor(s) 310, energy harvesting device 302, accumulator 306, but such an embodiment is within the scope of the invention.

Uphole control device 202 can also include additional modeling equipment for computing a trajectory for the drill string and monitoring any deviations from the desired trajectory. Such modeling equipment can be connected to additional modeling equipment, databases, and the like via communications technology such as telephone lines, satellite links, cellular telephone service, Ethernet, WLAN, DSL, and the like.

Incorporation by Reference

All patents, published patent applications, and other references disclosed herein are hereby expressly incorporated by reference in their entireties by reference.

Equivalents

Those skilled in the art will recognize, or be able to ascertain using no more than routine experimentation, many equivalents of the specific embodiments of the invention described herein. Such equivalents are intended to be encompassed by the following claims.

The invention claimed is:

1. A downhole communication device comprising:
- a first energy harvesting device;
- a downhole transceiver in communication with the first energy harvesting device;
- an accumulator in communication with the energy harvesting device; and
- a microcontroller, wherein said microcontroller manages communication between the first energy harvesting device, transceiver, and accumulator; estimates energy in the accumulator; and regulates power flow from the accumulator.

2. The downhole communication device of claim 1, further comprising:
- a sensor in communication with the microcontroller and the downhole transceiver.

3. The downhole communication device of claim 2, wherein the sensor is in wired communication with the microcontroller.

4. The downhole communication device of claim 2, wherein the sensor is in wireless communication with the microcontroller.

5. The downhole communication device of claim 2, further comprising:
- a second energy harvesting device, wherein the second energy harvesting device is in communication with the sensor.

6. The downhole communication device of claim 1, wherein the downhole transceiver is in communication with a second downhole transceiver located distant to the first downhole transceiver.

7. The downhole communication device of claim 1, wherein the first energy harvesting device is a substantially continuous power generator.

8. The downhole communication device of claim 7, wherein the substantially continuous power generator is one or more selected from the group consisting of: a triboelectric generator, an electromagnetic generator, and a thermoelectric generator.

9. The downhole communication device of claim 1, wherein the first energy harvesting device is a sporadic power generator.

10. The downhole communication device of claim 9, wherein the sporadic power generator is a piezoelectric generator.

11. The downhole communication device of claim 1, wherein the accumulator is one or more selected from the group consisting of: a hydro-pneumatic accumulator, a spring accumulator, an electrochemical cell, a battery, a rechargeable battery, a lead-acid battery, a capacitor, and a compulsator.

12. The downhole communication device of claim 1, wherein the microcontroller is configured to regulate the release of power from the accumulator.

13. The downhole communication device of claim 1 wherein the microcontroller estimates existing energy stored in the accumulator.

14. The downhole communication device of claim 1 wherein the downhole transceiver is selected from the group consisting of: an electrical transceiver, a hydraulic transceiver, and an acoustic transceiver.

15. A drilling control system comprising:
- an uphole communication device;
- a downhole communication device comprising:
  - a first energy harvesting device;
  - a first downhole transceiver in communication with the first energy harvesting device;
  - a first accumulator in communication with the first energy harvesting device;
  - a first microcontroller, wherein the first microcontroller manages communication between the first energy harvesting device, the first downhole transceiver, and the first accumulator; and
  - a sensor in communication with the microcontroller and the first downhole transceiver; and
- at least one repeater comprising:
  - a second energy harvesting device;
  - a second downhole transceiver in communication with the second energy harvesting device;
  - a second accumulator in communication with the second energy harvesting device; and
  - a second microcontroller, wherein the second microcontroller manages communication between the second energy harvesting device, the second downhole transceiver, and the second accumulator, wherein at least one of the first microcontroller and the second microcontroller estimates energy stored in and regulates power flow from at least one of the first accumulator and the second accumulator.

16. The drilling control system of claim 15 further comprising:
- an uphole communication device comprising:
  - a power source; and
  - a receiver electrically coupled to the power source.

17. The drilling control system of claim 16, wherein the uphole communication device further comprises:
- a transmitter electrically coupled to the power source.

18. The drilling control system of claim 17, wherein the downhole communication device further comprises:
- a receiver electrically coupled with the microprocessor.

19. A method of downhole drilling comprising:
- providing a downhole component comprising:
  - a first energy harvesting device;
  - a first downhole transceiver in communication with the first energy harvesting device;
  - a first accumulator in communication with the first energy harvesting device;
  - a first microcontroller, wherein the first microcontroller manages communication between the first energy harvesting device, the first downhole transceiver, and the first accumulator; and
  - a sensor in communication with the microcontroller and the first downhole transceiver;

providing at least one repeater comprising:

a second energy harvesting device;

a second downhole transceiver in communication with the second energy harvesting device;

a second accumulator in communication with the second energy harvesting device; and a second microcontroller, wherein the second microcontroller manages communication between the second energy harvesting device, the second downhole transceiver, and the second accumulator;

providing an uphole component comprising:

a power source; and a receiver electrically coupled to the power source;

obtaining drilling data from the sensor;

transmitting the drilling data from the downhole component to the first of the at least one repeater;

relaying the drilling data to any subsequent repeaters;

transmitting the drilling data from the last of the least one repeater to the uphole component; and using at least one of the first microcontroller and the second microcontroller to estimate energy in and to control power flow from at least one of the first accumulator and the second accumulator.

* * * * *